United States Patent [19]

Wonnacott

[11] Patent Number: 4,872,234

[45] Date of Patent: Oct. 10, 1989

[54] WATER SPRINKLER HEAD CLEANING TOOL

[76] Inventor: Gary C. Wonnacott, 6237 Bonsall Dr., Malibu, Calif. 90265

[21] Appl. No.: 215,368

[22] Filed: Jul. 5, 1988

[51] Int. Cl.[4] ..... B05C 15/02; B08B 9/02

[52] U.S. Cl. ..... 15/104.16; 15/104.05

[58] Field of Search ..... 15/104 R, 104.16, 104.05, 15/104.165; 122/379; 239/114

[56] References Cited

U.S. PATENT DOCUMENTS

| | | | |
|---|---|---|---|
| 241,197 | 5/1881 | de Luna . | |
| 959,680 | 5/1910 | Yerkey | 15/104.165 |
| 1,256,478 | 2/1918 | Hansen | 15/104.165 |
| 1,288,495 | 12/1918 | Brooks . | |
| 1,613,230 | 1/1927 | Longstaff . | |
| 2,001,635 | 5/1935 | Sturgis | 15/104.16 |
| 2,156,744 | 5/1939 | Smith . | |
| 2,318,696 | 5/1943 | Linden | 15/104.05 |
| 2,429,581 | 10/1947 | Maitlen . | |
| 2,503,380 | 4/1950 | Derby | 15/104.05 |
| 2,730,469 | 1/1956 | Harwedel . | |
| 3,168,799 | 2/1965 | Johnson . | |
| 3,609,790 | 10/1971 | Butch | 15/104.165 |

FOREIGN PATENT DOCUMENTS

| | | | |
|---|---|---|---|
| 34025 | 8/1905 | Switzerland | 15/104.165 |
| 705756 | 3/1954 | United Kingdom | 15/104.16 |

*Primary Examiner*—Edward L. Roberts

*Attorney, Agent, or Firm*—Marvin E. Jacobs

[57] ABSTRACT

A water sprinkler head cleaning tool is adapted for use in cleaning a clogged sprinkler head while the sprinkler is operating. The cleaning tool has a handle with a straight or T-shaped configuration, an elongated thin metallic needle-like unclogging shaft, and a water spray deflecting shroud with a flared configuration attached to a low profile tapered mounting tip disposed at the forward end of the handle or attached to the handle itself rearwardly of the mounting tip. The shaft is embedded at its rearward end portion in the handle tip and projects forwardly therefrom to an outer pointed end with a knurled region rearwardly of the pointed end. The shroud extends from the handle forward end in surrounding relation to the elongated shaft. The conical flared configuration of the shroud deflects or diverts any flow of water emanating from the clogged head during cleaning of the orifice so that it does not hit the person using the tool. The shroud is preferably composed of a mesh-like material which will slow down the flow of water so that the person does not get wet but does not block the water flow from going through the shroud.

30 Claims, 2 Drawing Sheets

WATER SPRINKLER HEAD CLEANING TOOL

DESCRIPTION

BACKGROUND OF THE INVENTION

The present invention relates generally to tools for cleaning fluid nozzle orifices and, more particularly, is concerned with a tool for cleaning an orifice of a water sprinkler head while the sprinkler is operating.

Sprinkler heads frequently become clogged with debris or mineral deposits and so require periodic inspection and servicing to ensure they are in proper operating condition. A sprinkler head which is even only partially clogged will fail to broadcast and distribute water in the desired pattern. In regions of the country where water is in limited supply, partially clogged sprinkler heads can result in an inefficient, wasteful and expensive use of a valuable resource.

To ensure that sprinkler heads will be inspected and serviced in timely fashion, the maintenance procedures should be easy and convenient to carry out. However, this has not been the case up to the present time. The typical approach to unclogging a clogged sprinkler head once discovered has been to shut off the sprinkler system and then to disassemble the clogged one of the sprinkler heads in order to remove the debris. Because this approach is time-consuming and tedious, many persons will neglect to provide proper maintenance of the sprinkler heads in a timely fashion.

Many different tools for cleaning fluid nozzle orifices of various configurations appear in the prior patent art. Representative of the prior art are the tools disclosed in U.S. Pat. Nos. to de Luna (241,197), Brooks (1,288,495), Longstaff (1,613,230), Sturgis (2,001,635), Smith (2,156,744), Linden (2;318,696), Maitlen (2,429,581), Harwedel (2,730,469) and Johnson (3,168,799). Many of these tools might operate reasonably well and generally achieve their objectives under the limited range of operating conditions for which they were designed. However, none of these tools suggests a way to modify the typical approach to cleaning out clogged sprinkler heads so as to encourage persons to inspect and service the sprinkler heads more often.

Consequently, a need exists for a cleaning tool especially designed for making it easy and simple to the service a clogged sprinkler head.

SUMMARY OF THE INVENTION

The present invention provides a water sprinkler head cleaning tool designed to satisfy the aforementioned needs. The tool of the present invention is adapted for cleaning an orifice of a water sprinkler head while the sprinkler is operating. The tool has an elongated metallic needle-like shaft with a pointed end and knurled region rearwardly of the pointed end being substantially smaller in diameter than the orifice so that the shaft can readily be inserted into a clogged orifice of a clogged sprinkler while the water is running and pulled in and out so as to poke and grind away the obstruction. The loosened debris is then removed by the force of the flowing water. The tool also has a flared water spray deflecting shroud surrounding the unclogging shaft which protects the user from getting wet while using the tool with the sprinkler operating. The tool handle has a low profile reverse tapered forward mounting tip which allows the tip of the handle to be placed close to the orifice without interfering with the sprinkler head. The tool thus eliminates the need to shut off the sprinkler system and disassemble the clogged head in order to clean it. As a result, the capability of a person to perform timely maintenance on sprinkler heads is enhanced.

Accordingly, the present invention is directed to a water sprinkler head cleaning tool, comprising: (a) an elongated handle having a forward end; and (b) an elongated thin metallic needle-like debris-unclogging shaft having forward and rearward end portions. The handle includes a mounting tip disposed at its forward end. The mounting tip has a diameter smaller than that of the remainder of the handle and a tapered low profile. The elongated unclogging shaft is embedded at its rearward end portion in handle tip and projects forwardly therefrom. More particularly, the mounting tip has rearward and forward oppositely-tapered tandemly-arranged axial sections.

The water spray deflecting shroud also has a conically flared configuration increasing in diameter from its rear mounting portion thereof to its front open portion. The shroud is composed of a mesh-like material adapted to deflect the water spray but allow passage thereof through the material at a substantially reduced rate of flow. Also, forward end portion of the unclogging shaft has an outer pointed end and an axially and circumferentially roughened region extending rearwardly of the pointed end. Preferably, the roughened region of the shaft has a knurled configuration.

The cleaning tool further comprises a water spray deflecting shroud having a front open portion and a rear mounting portion. The shroud mounting portion is adapted to fit over either the forward end of the handle rearwardly of the mounting tip thereon or over the mounting tip itself such that the shroud will extend from the handle forward end in surrounding relation to the elongated shaft. Means in the form of a removable and adjustable clamp is provided for attaching the rear mounting portion of the shroud to the handle forward end.

The water spray deflecting shroud also has a conically flared configuration increasing in diameter from its rear mounting portion thereof to its front open portion. The shroud is composed of a mesh-like material adapted to deflect the water spray but allow passage thereof through the material at a substantially reduced rate of flow. Also, forward end portion of the unclogging shaft has an outer pointed end and an axially and circumferentially roughened region extending rearwardly of the pointed end. Preferably, the roughened region of the shaft has a knurled configuration.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
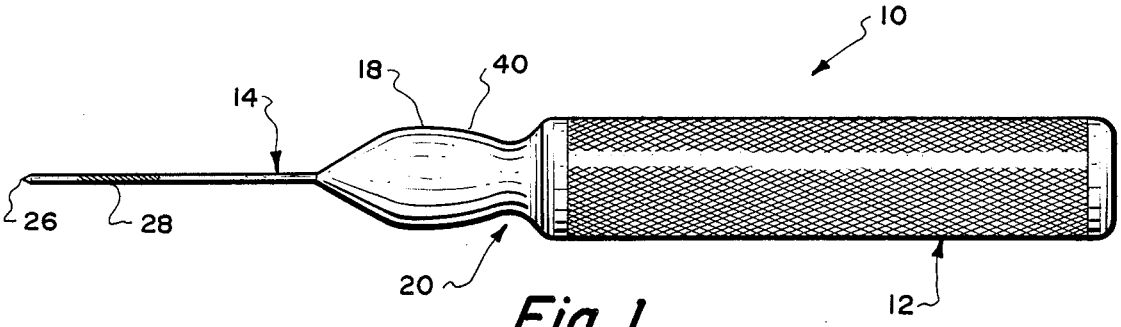
FIG. 1 is a side elevational view of an embodiment of the water sprinkler head cleaning tool of the present invention having a straight handle and without the spray deflecting shroud being illustrated.
Figure 2:
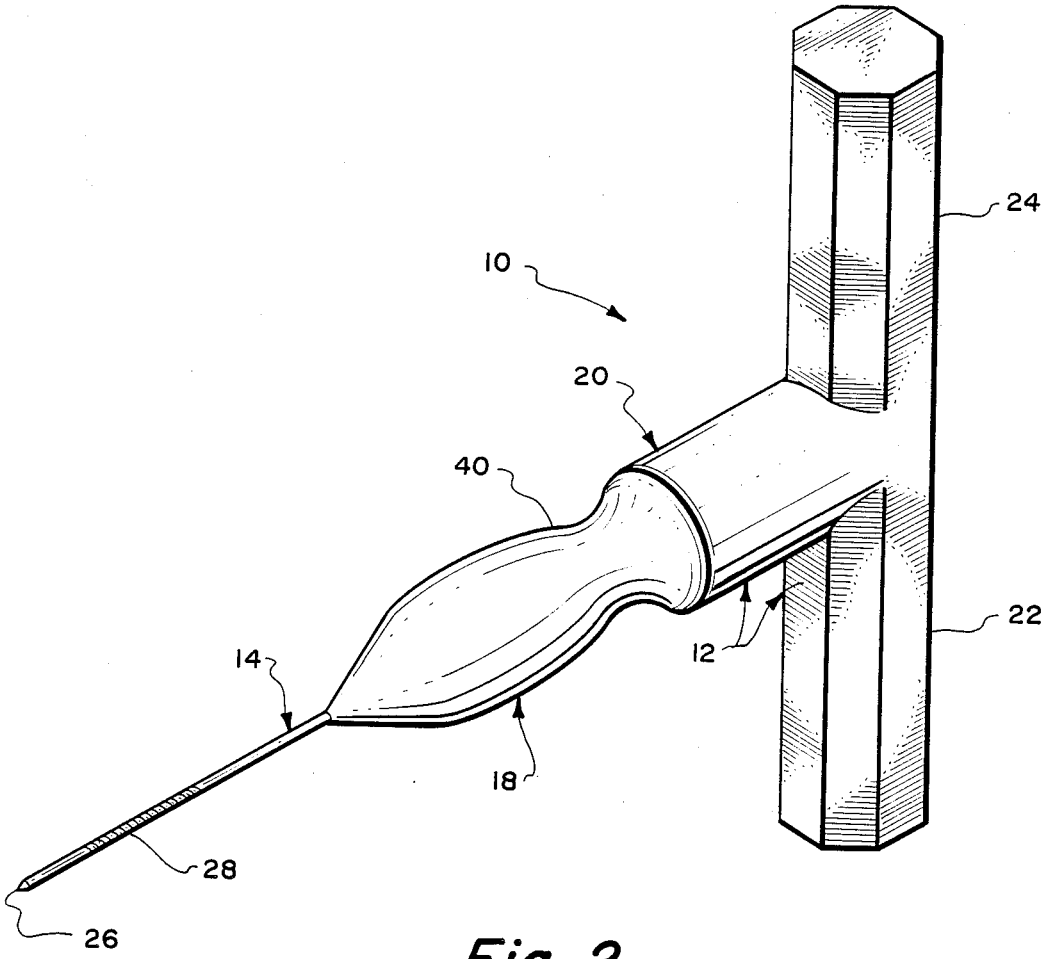
FIG. 2 is a perspective view, on slightly larger scale than that in FIG. 1, of another embodiment of the cleaning tool of the present invention having a T-shaped handle and without the spray deflecting shroud being illustrated.

Referring now to the drawings, and particularly to FIGS. 1 and 2, there are shown slightly different embodiments of a water sprinkler head cleaning tool, being indicated generally by the numeral 10 and constructed in accordance with the principles of the present invention. The cleaning tool 10 is adapted for use in cleaning out a clogged sprinkler head while the sprinkler is operating, in other words, without turning the water off and without taking the sprinkler head apart.

Basically, the cleaning tool 10 has an elongated handle 12, an elongated thin cylindrical metallic needle-like debris-unclogging shaft 14, and a water spray deflecting shroud 16 with a flared configuration attached to a low profile tapered mounting tip 18 disposed at the forward end 20 of the handle 12 or attached to the forward end 20 of the handle 12 itself immediately rearwardly of the mounting tip 18. The shaft 14 is embedded at its rearward end portion in the handle tip 18 and projects forwardly therefrom.

More particularly, the handle 12 of a suitable diameter for being gripped by a user's hand is composed of wood or plastic for example, and has either the straight configuration as seen in FIG. 1 or alternatively the T-shaped configuration as seen in FIG. 2. In the latter configuration, the forward end 20 of the handle 12 is the vertical part of the T, whereas the fingers of the user's hand encircle the branches 22, 24 of the T with two fingers on each side of the vertical part 20.

The thin needle-like debris-unclogging shaft 14 is embedded at its rearward end portion in the handle tip 18, such as by being threaded and screwed therein, and projects forwardly therefrom. The shaft 14 has a forward pointed end 26 with a roughened, such as a knurled, axially and circumferentially extending region 28 located rearwardly of and spaced from the shaft pointed end 26.

Figure 4:
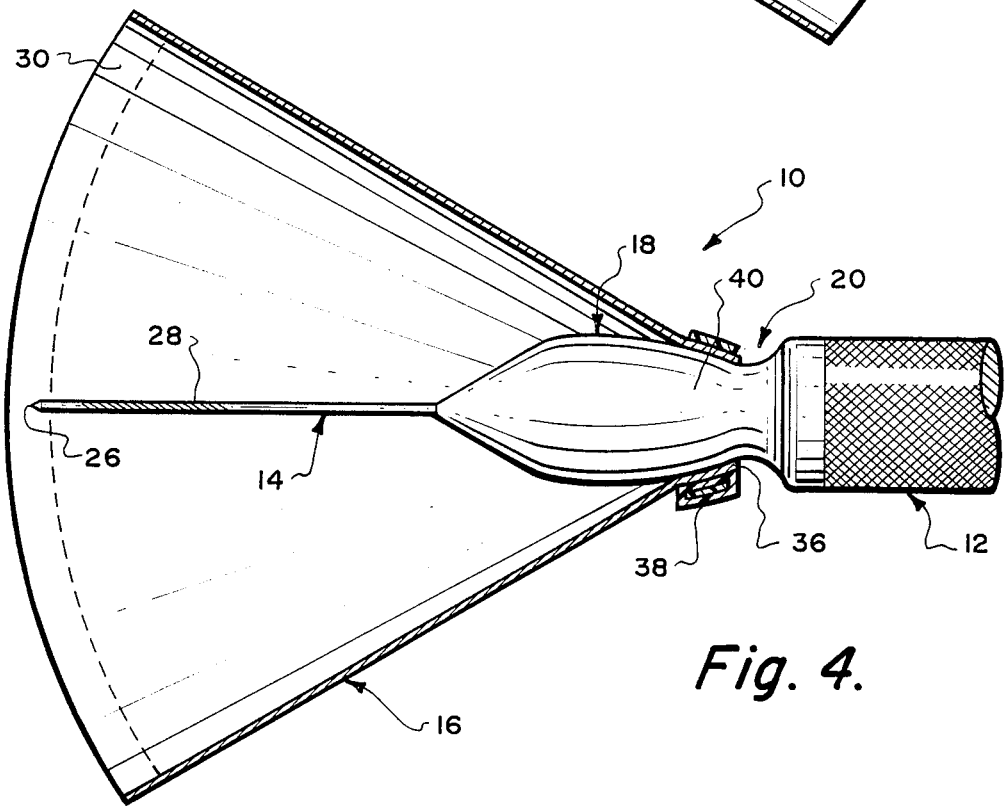
FIG. 4 is a fragmentary view, on the same scale as in FIGS. 2 and 3, of another embodiment of the cleaning tool with the spray deflecting shroud clamped about a rear portion of a mounting tip disposed at the forward end of the tool handle.

The shroud 14 extends from the handle forward end 20 in surrounding relation to the elongated shaft 14. The shaft 14 can either be slightly shorter or longer than the shroud 16, as depicted in FIG. 4 by the full and dashed lines defining the forward open end 30 of the shroud 16. The conical flared configuration of the shroud 16 deflects or diverts any flow of water emanating from the clogged head during cleaning of the orifice so that it does not hit the person using the tool. Also, the flared open configuration and generally flexible nature of the shroud 16 allows it to fit over parts of the sprinkler without interfering with their operation. The shroud 16 is preferably composed of a mesh-like material, such as stainless steel mesh or cloth, which is flexible and will slow down the flow of water so that the person holding the tool 10 does not get wet but does not block the water flow from going through the shroud. Since flow of water is not blocked, the flowing water does not exert as much force on the handle as would be the case with a totally impervious shroud.

Figure 3:
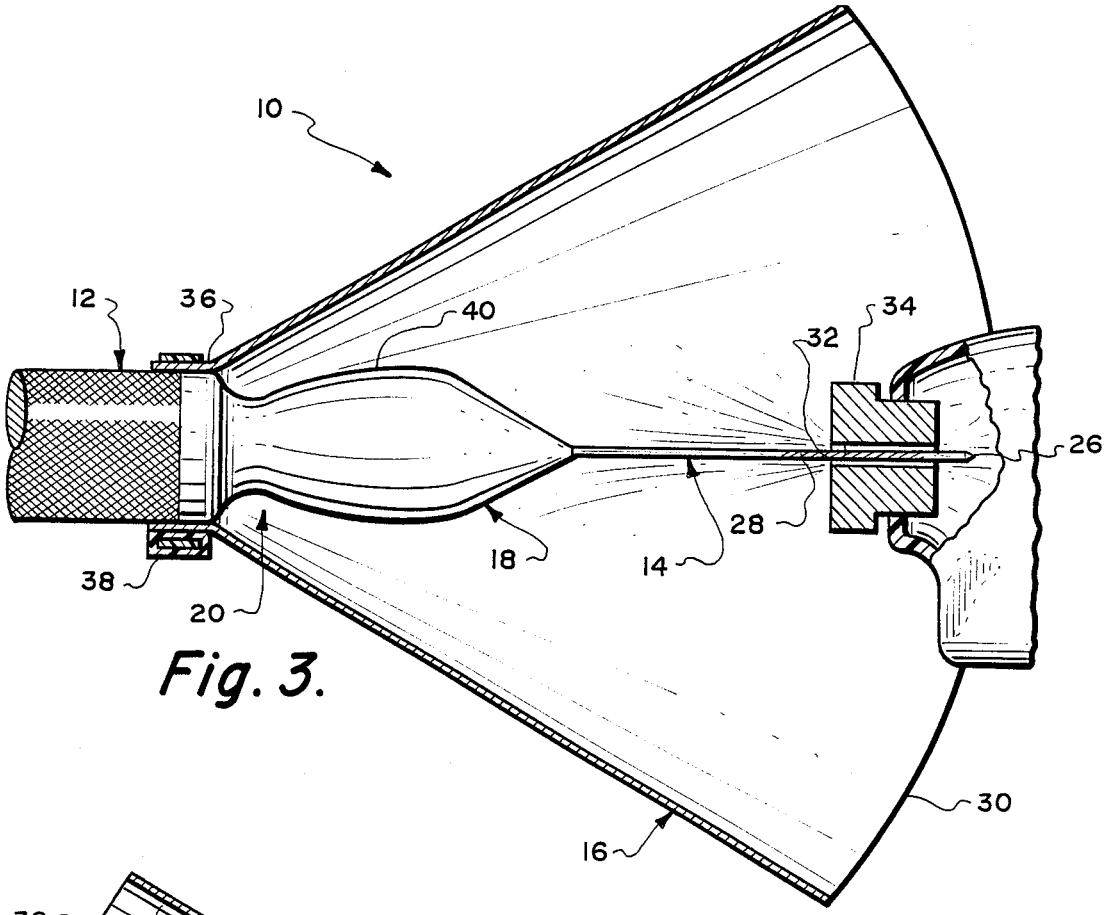
FIG. 3 is a fragmentary view, on the same scale as in FIG. 2, of an embodiment of the cleaning tool with the spray deflecting shroud clamped about a forward end of the tool handle.

As depicted in FIG. 3, the pointed end 26 and knurled region 30 of the shaft 14 are substantially smaller in diameter than the orifice 32 of the sprinkler head 34. Thus, the shaft 14 can easily be inserted into a clogged orifice of a clogged sprinkler while the water is running and pulled in and out so as to poke, grind away and loosen the obstruction. The loosened debris will then removed by the force of the flowing water.

The mounting tip 18 disposed at the forward end 20 of the tool handle 12 is shown integrally connected to the remainder of the handle 12. However, it could be a separate part which is detachably threaded to the handle so that it can be replaced should the shaft break. Preferably, the mounting tip 18 has a rearward and forward double or reverse tapered, sections, 40, 42 of low profile configuration respectively for allowing the mounting tip 18 to be placed close to the orifice 32 without interfering with the sprinkler head 34 and for providing secure attachment of the shroud 16 thereto. The configuration of the mounting tip 18 also serves to deflect the spray radially outward toward the shroud 16.

As illustrated in FIGS. 3 and 4, the shroud 16 has a rearward annular mounting portion 36 by which it can either be clamped to the full diameter portion of the forward end 20 of the handle 12 just rearwardly of the tapered mounting tip 18 as shown in FIG. 3 or clamped to the reduced diameter mounting tip 18 itself as shown in FIG. 4. In either version, the attaching means is preferably a clamp 38 which is both removable and adjustable. By way of example, the clamp 38 can be a ring-type one composed of flexible strap-like plastic material or metal strip. In the embodiment of FIG. 4, the rear mounting portion 36 of the shroud 16 is fitted over and clamped to the rearward tapered section 40 of the mounting tip 18. The rearward tapered section 40 of the mounting tip 18 is connected to the forward end of the handle 12 and located rearwardly of the oppositely-tapered forward tapered section 42 of the mounting tip 18. A middle axial section 44 of the mounting tip 18 defining the maximum diameter of the tip 18 is located between and interconnects the rearward and forward oppositely-taped sections 40, 42 of the tip.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

Having thus described the invention, what is claimed is:

1. A water sprinkler head cleaning tool, comprising:
(a) an elongated handle having a forward end; and
(b) an elongated thin metallic needle-like debris-unclogging shaft having forward and rearward end portions;
(c) said handle including a mounting tip disposed at said handle forward end, said mounting tip having a diameter smaller than that of the remainder of said handle and a tapered low profile, said shaft being embedded at its rearward end portion in said mounting tip and projecting forwardly therefrom;

(d) said mounting tip having rearward and forward oppositely-tapered axial sections and a middle section located between and interconnecting said rearward and forward sections and defining the maximum diameter of said mounting tip, said rearward and forward sections extending in opposite rearward and forward directions from said middle section, said forward tapered section providing a low profile configuration for allowing said mounting tip to be placed close to an orifice of the water sprinkler head and said rearward tapered section being connected to said handle forward end and providing an axial region on said tip for secure attachment of a water spray deflecting shroud thereto rearwardly of said maximum diameter middle section of said mounting tip.

2. The cleaning tool of claim 1 wherein said handle has a generally straight configuration.

3. The cleaning tool of claim 1 wherein said handle has a generally T-shaped configuration.

4. The cleaning tool of claim 1 wherein said shaft is composed of stainless steel.

5. The cleaning tool of claim 1 wherein said forward end portion of said shaft has an outer pointed end and an axially and circumferentially roughened region extending rearwardly of said pointed end.

6. The cleaning tool of claim 5 wherein said roughened region of said shaft has a knurled configuration.

7. A water sprinkler head cleaning tool, comprising:

(a) an elongated handle having a forward end; and (b) an elongated thin metallic needle-like debris-unclogging shaft having forward and rearward end portions;

(c) said handle including a mounting tip disposed at said handle forward end, said mounting tip having a diameter smaller than that of the remainder of said handle and a tapered low profile, said shaft being embedded at its rearward end portion in said mounting tip and projecting forwardly therefrom;

(d) a water spray deflecting shroud having a front open portion and a rear mounting portion, said mounting portion being adapted to fit over said forward end of said handle rearwardly of said mounting tip thereon such that said shroud extends from said handle forward end in surrounding relation to said elongated shaft.

8. The cleaning tool of claim 7 further comprising:

(e) means for attaching said rear mounting portion of said shroud to said handle forward end rearwardly of said mounting tip of said handle.

9. The cleaning tool of claim 8 wherein said attaching means is a removable and adjustable clamp.

10. The cleaning tool of claim 9 wherein said clamp is composed of flexible strap-like material.

11. The cleaning tool of claim 7 wherein said shroud has a conically flared configuration increasing in diameter from said rear mounting portion thereof to said front open portion of said shroud.

12. The cleaning tool of claim 7 wherein said shroud is composed of a mesh-like material adapted to deflect the water spray but allow passage thereof through said material at a substantially reduced rate of flow.

13. The cleaning tool of claim 12 wherein said mesh-like material is composed of stainless steel, synthetic plastic or an elastomer.

14. A water sprinkler head cleaning tool, comprising:

(a) an elongated handle having a forward end; and (b) an elongated thin metallic needle-like debris-unclogging shaft having forward and rearward end portions;

(c) said handle including a mounting tip disposed at said handle forward end, said mounting tip having a diameter smaller than that of the remainder of said handle and a tapered low profile, said shaft being embedded at its rearward end portion in said mounting tip and projecting forwardly therefrom;

(d) a water spray deflecting shroud having a front open portion and a rear mounting portion, said mounting portion being adapted to fit over said mounting tip on said forward end of said handle such that said shroud extends from said mounting tip in surrounding relation to said elongated shaft.

15. The cleaning tool of claim 14 further comprising:

(e) means for attaching said rear mounting portion of said shroud to said mounting tip.

16. The cleaning tool of claim 15 wherein said mounting tip has rearward and forward oppositely-tapered tandemly-arranged axial sections, said rear mounting portion of said shroud being fitted over and clamped to said rearward tapered section of said mounting tip.

17. The cleaning tool of claim 15 wherein said attaching means is a removable and adjustable clamp.

18. The cleaning tool of claim 17 wherein said clamp is composed of flexible strap-like material.

19. The cleaning tool of claim 14 wherein said shroud has a conically flared configuration increasing in diameter from said rear mounting portion thereof to said front open portion of said shroud.

20. The cleaning tool of claim 14 wherein said shroud is composed of a mesh-like material adapted to deflect the water spray but allow passage thereof through said material at a substantially reduced rate of flow.

21. The cleaning tool of claim 20 wherein said mesh-like material is composed of stainless steel.

22. A water sprinkler head cleaning tool, comprising:

(a) an elongated handle having a forward end;

(b) an elongated thin metallic needle-like debris-unclogging shaft having forward and rearward end portions, said shaft being embedded at its rearward end portion in said forward end of said handle and projecting forwardly therefrom; and (c) a water spray deflecting shroud having a front open portion and a rear mounting portion, said mounting portion being adapted to fit over and attach to said forward end of said handle such that said shroud extends from said handle forward end in surrounding relation to said elongated shaft.

23. The cleaning tool of claim 22 wherein said handle has a generally straight configuration.

24. The cleaning tool of claim 22 wherein said handle has a generally T-shaped configuration.

25. The cleaning tool of claim 22 further comprising:

(d) means for attaching said rear mounting portion of said shroud to said handle forward end.

26. The cleaning tool of claim 25 wherein said attaching means is a removable and adjustable clamp.

27. The cleaning tool of claim 22 wherein said shroud has a conically flared configuration increasing in diameter from said rear mounting portion thereof to said front open portion of said shroud.

28. The cleaning tool of claim 22 wherein said shroud is composed of a mesh-like material adapted to deflect the water spray but allow passage thereof through said material at a substantially reduced rate of flow.

29. The cleaning tool of claim 22 wherein said forward end portion of said shaft has an outer pointed end and an axially and circumferentially roughened region extending rearwardly of said pointed end.

30. The cleaning tool of claim 29 wherein said roughened region of said shaft has a knurled configuration.

* * * * *